US005929740A

United States Patent [19]

Oh et al.

[11] Patent Number: 5,929,740

[45] Date of Patent: Jul. 27, 1999

[54] ONE-PIECE FEMALE BLADE FUSE WITH HOUSING AND IMPROVEMENTS THEREOF

[75] Inventors: Seibang Oh, Elk Grove Village; James J. Beckert, Elgin; Theodore W. Humphrey, Palatine; William P. Hendrickson, Westmont, all of Ill.

[73] Assignee: Littelfuse, Inc., Des Plaines, Ill.

[21] Appl. No.: 08/957,878

[22] Filed: Oct. 20, 1997

Related U.S. Application Data

[63] Continuation-in-part of application No. 08/421,441, filed as application No. PCT/US96/05628, Apr. 20, 1995, Pat. No. 5,581,225.

[51] Int. Cl.[6] ..... H01H 85/08; H01H 85/143; H01H 85/153

[52] U.S. Cl. ..... 337/198; 337/197; 337/180; 337/295; 337/251

[58] Field of Search ..... 337/198, 180, 337/197, 260–265, 295, 161, 251, 255; 439/621, 622, 366, 830–833, 250

[56] References Cited

U.S. PATENT DOCUMENTS

| | | | |
|---|---|---|---|
| 33,137 | 12/1861 | Gurevich et al. | 337/255 |
| 2,649,522 | 8/1953 | Marcus | 200/115.5 |
| 2,774,951 | 12/1956 | Kinkaid et al. | 339/258 |
| 2,903,539 | 9/1959 | Matthysse et al. | 200/129 |
| 2,921,287 | 1/1960 | Matthysse et al. | 339/258 |

(List continued on next page.)

FOREIGN PATENT DOCUMENTS

| | | | |
|---|---|---|---|
| 228 490A1 | 7/1987 | European Pat. Off. . | |
| 0463608 A3 | 1/1992 | European Pat. Off. . | |
| 633592A1 | 1/1995 | European Pat. Off. . | |
| 0633592 A1 | 11/1995 | European Pat. Off. | H01H 85/045 |
| 1312116 | 11/1962 | France . | |
| 1567727 | 5/1969 | France . | |
| 2557355 | 12/1989 | France . | |
| 1615002 | 5/1970 | Germany . | |
| 2517069 | 10/1976 | Germany . | |
| 27 14 797 | 2/1979 | Germany . | |
| 43 40 979 A 1 | 7/1994 | Germany . | |
| 626449 | 10/1961 | Italy . | |
| 56-53 | 1/1981 | Japan . | |
| 57-15141 | 9/1982 | Japan . | |
| 57-210537 | 12/1982 | Japan . | |

(List continued on next page.)

*Primary Examiner*—Leo P. Picard
*Assistant Examiner*—Anatoly Vortman
*Attorney, Agent, or Firm*—Wallenstein & Wagner Ltd.

[57] ABSTRACT

A female fuse includes two female terminal portions and a fuse link with a skived region. The fuse link can have first and second ends with first and second pellet regions, each pellet region having a pellet hole therein, the first and second pellet regions being substantially symmetrically spaced on opposing sides of a central axis of the female fuse. Such a fuse link also includes first and second art-forming strips substantially symmetrically connecting the first and second pellet regions to one another, an interior portion of the arc-forming strips being substantially formed from a die section which is independent of the die section which forms the exterior shape of the female fuse. The female fuse terminals each have female-forming terminal plates and female-forming side plates, the terminal plates each having a spring portions, the spring portions being formable into contacting springs for the male terminals. A female fuse housing is also provided for the female fuse. The female fuse housing has a sidewall having an inner surface and an exterior surface, the inner surface defining a fuse insertion area for housing the female fuse. The housing also has an insertion end adapted for receiving the female fuse, and a terminal entry end located opposite the fuse insertion end, and having a first terminal socket and a second terminal socket. The housing also has a divider positioned within the fuse insertion area between the first terminal socket and the second terminal socket, having a first side and a second side, to define a first female receptor chamber and a second female receptor chamber each having a plurality of female fuse retainers.

20 Claims, 11 Drawing Sheets

U.S. PATENT DOCUMENTS

| | | | |
|---|---|---|---|
| 2,996,026 | 8/1961 | Batcheller | 113/119 |
| 3,139,318 | 6/1964 | Binder et al. | 339/256 |
| 3,148,257 | 9/1964 | Feenan et al. | 200/135 |
| 3,288,968 | 11/1966 | Feenan et al. | 200/135 |
| 3,409,867 | 11/1968 | Lessner | 339/258 |
| 3,524,157 | 8/1970 | Salzer | 337/159 |
| 3,550,069 | 12/1970 | Teagno | 339/256 |
| 3,813,626 | 5/1974 | Cetola et al. | 337/245 |
| 3,995,929 | 12/1976 | Ghirardi et al. | 339/32 |
| 4,099,320 | 7/1978 | Schmidt, Jr. | 29/623 |
| 4,131,869 | 12/1978 | Schmidt, Jr. et al. | 337/264 |
| 4,196,409 | 4/1980 | Juba | 337/198 |
| 4,253,080 | 2/1981 | Howard | 337/159 |
| 4,297,666 | 10/1981 | Asdollahi | 337/163 |
| 4,310,719 | 1/1982 | Cross et al. | 174/94 |
| 4,319,213 | 3/1982 | Reid | 337/161 |
| 4,344,060 | 8/1982 | Ciesemier et al. | 337/260 |
| 4,417,225 | 11/1983 | Muller et al. | 337/198 |
| 4,430,633 | 2/1984 | Ebi | 337/166 |
| 4,448,468 | 5/1984 | Coldren | 339/74 R |
| 4,451,109 | 5/1984 | Inoue | 339/258 |
| 4,544,907 | 10/1985 | Takano | 337/262 |
| 4,553,808 | 11/1985 | Weidler et al. | 339/97 R |
| 4,556,274 | 12/1985 | Olivera | 339/147 R |
| 4,570,147 | 2/1986 | Ebi | 337/166 |
| 4,604,602 | 8/1986 | Borzoni | 337/264 |
| 4,612,529 | 9/1986 | Gurevich et al. | 337/255 |
| 4,635,023 | 1/1987 | Oh | 337/163 |
| 4,646,052 | 2/1987 | Matsumaga et al. | 337/166 |
| 4,661,793 | 4/1987 | Borzoni | 337/260 |
| 4,670,729 | 6/1987 | Oh | 337/264 |
| 4,672,352 | 6/1987 | Takano | 337/264 |
| 4,685,754 | 8/1987 | Coldren | 439/270 |
| 4,691,981 | 9/1987 | Coldren | 439/816 |
| 4,751,490 | 6/1988 | Hatagishi | 337/295 |
| 4,764,133 | 8/1988 | Kaneko | 439/889 |
| 4,781,628 | 11/1988 | Detter et al. | 439/748 |
| 4,800,358 | 1/1989 | Takenouchi et al. | 337/268 |
| 4,808,962 | 2/1989 | Ikeda | 337/203 |
| 4,810,215 | 3/1989 | Kaneko | 439/865 |
| 4,842,534 | 6/1989 | Mobley et al. | 439/214 |
| 4,869,972 | 9/1989 | Hatagishi | 428/647 |
| 4,871,990 | 10/1989 | Ikeda et al. | 337/238 |
| 4,944,084 | 7/1990 | Horibe et al. | 29/623 |
| 4,944,697 | 7/1990 | Dorman | 439/621 |
| 4,958,426 | 9/1990 | Endo et al. | 29/623 |
| 4,975,551 | 12/1990 | Syvertson | 200/144 |
| 4,988,969 | 1/1991 | Gurevich | 337/260 |
| 4,992,062 | 2/1991 | Nakayama et al. | 439/621 |
| 5,049,095 | 9/1991 | Gugelmeyer | 439/856 |
| 5,091,712 | 2/1992 | Suuronen | 337/297 |
| 5,106,324 | 4/1992 | Natsume | 439/510 |
| 5,139,443 | 8/1992 | Armando | 439/620 |
| 5,147,230 | 9/1992 | Plyler et al. | 439/843 |
| 5,181,866 | 1/1993 | Jerome et al. | 439/850 |
| 5,229,739 | 7/1993 | Oh et al. | 337/290 |
| 5,262,751 | 11/1993 | Kudo et al. | 337/296 |
| 5,281,175 | 1/1994 | Chupak et al. | 439/839 |
| 5,293,147 | 3/1994 | Oh et al. | 337/227 |
| 5,294,906 | 3/1994 | Totsuka et al. | 337/260 |
| 5,346,411 | 9/1994 | Nikkinen | 439/621 |
| 5,350,321 | 9/1994 | Takenouchi | 439/839 |
| 5,357,234 | 10/1994 | Pimpis et al. | 337/246 |
| 5,361,058 | 11/1994 | Mosesian et al. | 337/163 |
| 5,374,590 | 12/1994 | Batdorf et al. | 437/173 |
| 5,488,346 | 1/1996 | Kondo et al. | 337/198 |

FOREIGN PATENT DOCUMENTS

| | | |
|---|---|---|
| 59-16054 | 1/1984 | Japan . |
| 59-178857 | 11/1984 | Japan . |
| 60-177527 | 9/1985 | Japan . |
| 61-294730 | 2/1986 | Japan . |
| 61-61331 | 3/1986 | Japan . |
| 61-166449 | 10/1986 | Japan . |
| 61-166450 | 10/1986 | Japan . |
| 61-240521 | 10/1986 | Japan . |
| 61-271731 | 12/1986 | Japan . |
| 64-60937 | 3/1989 | Japan . |
| 1-241728 | 9/1989 | Japan . |
| 1-241729 | 9/1989 | Japan . |
| 1-315924 | 12/1989 | Japan . |
| 2-66828 | 6/1990 | Japan . |
| 2-89753 | 7/1990 | Japan . |
| 2-199735 | 8/1990 | Japan . |
| 5-172050 | 7/1993 | Japan . |
| 5-205608 | 8/1993 | Japan . |
| 5-274995 | 10/1993 | Japan . |
| 6-13043 | 2/1994 | Japan . |
| 6-48149 | 6/1994 | Japan . |
| 720592 | 3/1980 | Russian Federation . |
| 858115 | 1/1961 | United Kingdom . |
| 2197759 | 5/1988 | United Kingdom . |
| 2228150 | 8/1990 | United Kingdom . |

371
376
376
373
376
376
364
365
368
369
331
333
354
345
355
358
359
329
313
378
347
378
351
337
307
305
309
301
317
339
341
321
325
203
213
228
222
226
206
216
200
218
214
210
218
220
230
212
202
328
316
320
324
340
300
336
306
338
304
350
378
378
344
312
346
308
352
353
312
356
357
332
330
363
362
366
367
376
376
376
376
370
372

ONE-PIECE FEMALE BLADE FUSE WITH HOUSING AND IMPROVEMENTS THEREOF

RELATED APPLICATIONS

This application claims priority from International Application No. PCT/US96/05628, filed Apr. 22, 1996, which is a continuation-in-part of U.S. patent application Ser. No. 08/421,441, filed on Apr. 20, 1995, and which issued on Dec. 3, 1996, as U.S. Pat. No. 5,581,225.

TECHNICAL FIELD

The present invention relates generally to electrical fuses. More particularly, this invention relates to female electrical fuses which are designed for connection into a fuse block having male terminal connections.

BACKGROUND OF THE INVENTION

Automobile and other female fuse assemblies commonly comprise a two-piece assembly heretofore having a box-like housing and an all metal one-piece female fuse secured therein. The female fuse has a pair of spaced apart female terminals which are accessible from one end of the housing where male terminal openings are placed in the housing to correspond to male blade-type terminals. The male blade-type terminals or conductors recently, typically extend from a mounting panel or male fuse block, as there has been a shift in the automotive industry toward the use of male terminal blocks. The female terminals are commonly closely encompassed by the housing walls. The female fuse also includes a fuse link extended, usually unsupported, between the female terminals. The connection or transition between the female terminals and the fuse link begins at the center of one female terminal and extends linearly, from a side view, to the other female terminal, without any lateral movement from a top view. From this top view, the width of the fuse link is typically narrowed to create a fuse blowing portion.

Some female fuses use an additional component with the fuse link, such as a ceramic member, for heat conduction purposes to achieve a desired fuse characteristic. The fuse link and additional component are commonly spaced close to the housing side walls for a reduced volume of used material. The above identified two-piece female fuse assembly, with a one piece fuse, is generally disclosed in U.S. Pat. Nos. 4,570,147 (Ebi), 4,751,490 (Hatagishi), 4,869,972 (Hatagishi), 4,871,990 (Ikeda et al.), and 4,958,426 (Endo). However, there are numerous disadvantages with these and other fuses of this type based on the heretofore mentioned female fuse configurations.

Specifically, when the width of the fuse link is narrowed by cutting into the fuse link, it is very difficult to achieve a width which is consistent across the full length of the fuse blowing portion. The consistency of this width is significant because the width of the fuse blowing portion can be used to control the time delay of the fuse. In addition, the use of a linear fuse link, which starts at the center of the female terminals, limits the length of the fuse link. When linear bends are added to increase the length of the fuse link, without any lateral bends, a substantial amount of surface area is discarded during manufacture, as disclosed in Ebi listed above. The length of the fuse link is significant, as the length can be used to control the resistance and, thus, the current rating of the fuse. However, the configuration in Ebi wastes a significant amount of metal during manufacture in order to increase the fuse link length. Furthermore, the use of an additional component with the fuse link, such as a ceramic member, for heat conduction purposes, increases the cost of the materials, and increases the amount of steps of the female fuse assembly.

As further background information for the present invention, European Patent Application EP 633,592 A1 discloses a fuse that also makes use of a fuse link (fusible portion) that extends linearly between the female fuse terminals, without any lateral bends from a top portion. However, the fuse disclosed in this EP 633,592 A1 has female fuse terminals that each use a single spring member in conjunction with a bottom plate to make a connection with respective male terminals. In such a configuration, the single spring member is the sole source of the force necessary to maintain the required connection forces between the female terminals and the respective male terminals that are inserted therein. In addition, the single spring member on each female terminal is bent in a manner such that only a very small surface area of the spring member actually contacts the male terminal when the male terminal is inserted into the female terminal. As such, the significant portion of the electrical connection between the male and female terminal takes place between the male terminal and the bottom plate. Reference DE 2714797 A1 discloses a male fuse which does have a single linear fuse link bend. However, the fuse link bend does not include a fuse-blowing portion, and does not allow for the rating of the fuse to be modified without significant modifications within the manufacturing process.

In addition, Endo discloses a female fuse and a method of the manufacture thereof. The method of manufacture includes punching steps in order to punch the fuse from a sheet metal 6. The female fuse is punched on the interior of the outer edges of the sheet metal 6. Punching on the interior of the sheet metal 6 causes a significant amount of the sheet metal 6 along the outer edges to be waisted.

The present invention is provided to solve these and other problems.

SUMMARY OF THE INVENTION

The present invention is a female fuse assembly. The fuse assembly, among other things, allows for a longer effective length of the fuse link and allows for a uniform reduction in the thickness of the fuse link, for controlling the resistance and time delay of the fuse while at the same time avoiding the above and others problems of previous one-piece female fuses. Generally the female fuse assembly will interrupt a current flowing through a circuit upon certain high current conditions. The circuit will include male terminals that have opposed contact surfaces which connect to female fuse assembly to conduct current through the circuit.

The female fuse assembly includes a female fuse and a housing. The female fuse includes a first and a second female terminal portion each having a face portion which includes a first end, a second end, a first side, and a second side, includes a first clamping arm and a second clamping arm. The female fuse also includes a first bracing arm and a second bracing arm connected to the respective first and second ends of the face portion of first and second female terminal portions. The female fuse further includes a fuse link having a first terminal extension and a second terminal extension connected to the respective first and second female terminal portions. The fuse link has a skived region connected between the first and second terminal extensions at a first transition point and a second transition point, respectively, for controlling the resistance between the first and second female terminal portions. The fuse link further includes a fuse-blowing portion and requires no additional structure for heat insulating the female fuse.

The fuse link further includes a first terminal bend and a second terminal bend. The first terminal bend is positioned substantially toward the second end of the face portion of the first female terminal portion, or vice versa. The second terminal bend is positioned substantially toward the first end of the face portion of the second female terminal portion, or vice versa. This positioning allows for increased length of the fuse link.

The connection between the first female terminal portion and the first terminal extension of the fuse link is positioned substantially toward one end of the face portion of the first female terminal portion. Similarly, the connection between the second female terminal portion and the second terminal extension of the fuse link is positioned substantially toward one end, but not limited to the other end, of the face portion of the second female terminal portion. The present invention can be configured in both a back-to-back or face-to-face arrangement while, at the same time, capturing the features and advantages set forth herein.

In an additional alternative and improved embodiment of the present invention, a female fuse is provided for interrupting a current flowing through a circuit including the female fuse upon certain high current conditions, and for accepting male terminals connected to the circuit. This female fuse comprises a fuse link having a first end and a second end, and a fuse-blowing portion between the first and second ends for interrupting the current flowing through the circuit. The female fuse further includes first and second female fuse terminals coupled to the respective first and second ends of the fuse link. The first and second female fuse terminals each have first and second female-forming terminal plates and first and second female-forming side plates. The first and second female-forming side plates are each coupled to the first female-forming plates at substantially respective first and second boundaries, and the second female-forming terminal plates are each coupled to the respective second side plates at substantially third boundaries, respectively. The first and the second female-forming terminal plates each have a spring portion, the spring portions being formable into contacting springs for contacting the male terminals when the male terminals are inserted into the female fuse terminals, once formed. The first and second female-forming side plates and the first and second female-forming terminal plates are formable to generally encompass the spring portions and the male terminals when the male terminals are inserted into the formed female fuse terminals.

During the manufacturing process of creating a plurality of the female fuses, the fuses are formed from a single sheet of metal, and the first and second female fuse terminals are coupled to the respective first and second ends of the fuse link. During the method of manufacture, first and second strips are stamped from the sheet of metal, with the alignment of the strips being traverse from length the female fuses, and with the strips located interior from the outermost portions of the female fuse terminals.

The female fuse is stamped from a single sheet of metal. The fuse link therein includes first and second plug or pellet regions (shown as circles in the Figures) between the first and second ends. Each pellet region can have a pellet hole therein, and the first and second pellet regions are substantially symmetrically spaced on opposing sides of a central axis of the female fuse located along the length of the fuse. The fuse link further includes first and second arc-forming strips substantially symmetrically connecting the first and second pellet regions to one another. An interior portion of the pellet regions and an interior portion of the arc-forming strips are substantially formed from a bow-tie stamp or die section which is independent of the stamp or die section that forms the exterior shape of the female fuse.

Other features and advantages of the invention will be apparent from the following specification taken in conjunction with the following drawing.

DETAILED DESCRIPTION OF THE PREFERRED EMBODIMENT

Figure 1:
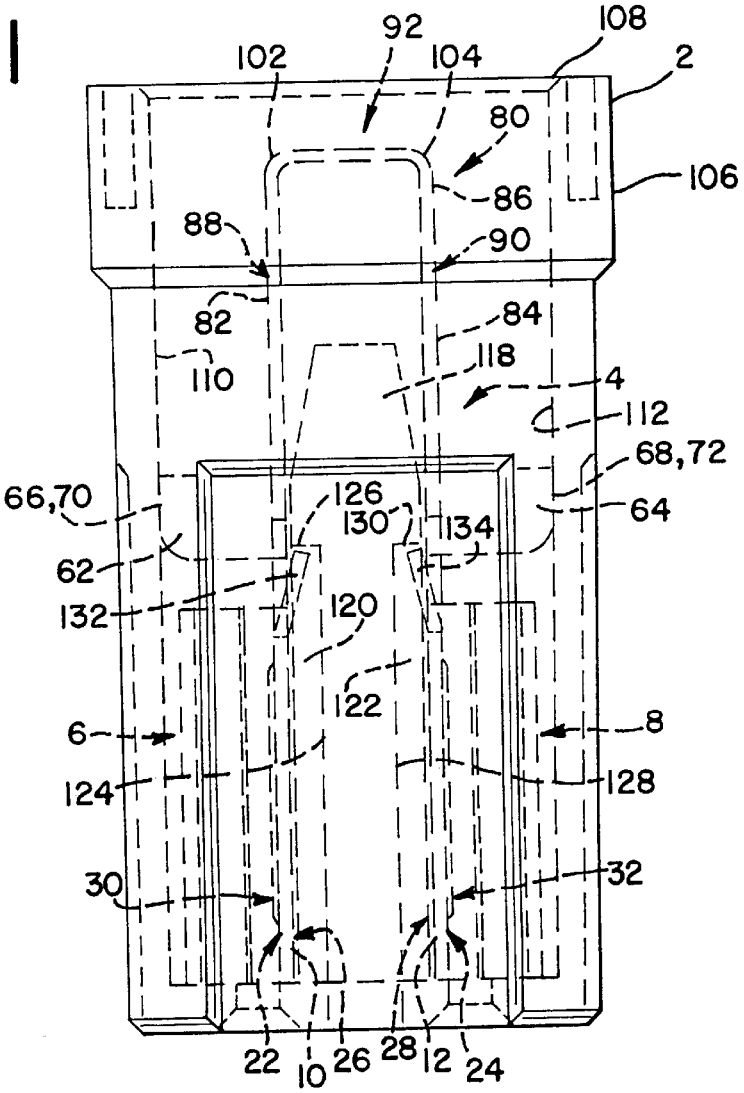
FIG. 1 is a front view of one embodiment of the female fuse assembly of the present invention.
Figure 2:
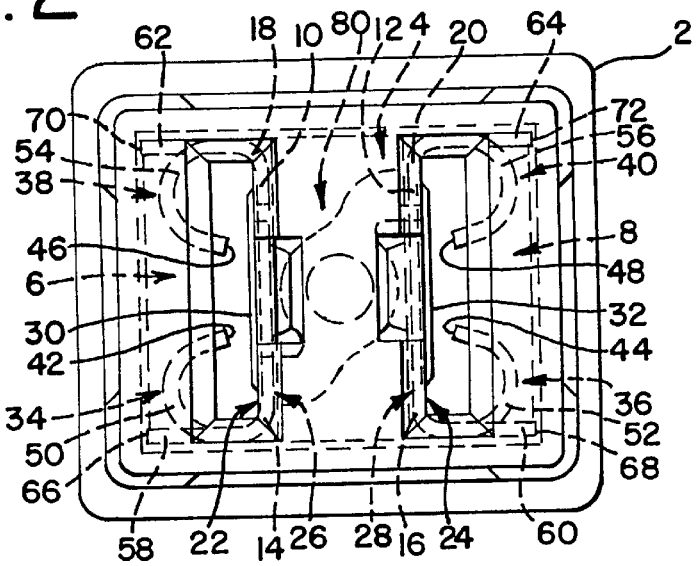
FIG. 2 is a bottom view of the embodiment from FIG. 1 of the present invention.
Figure 3:
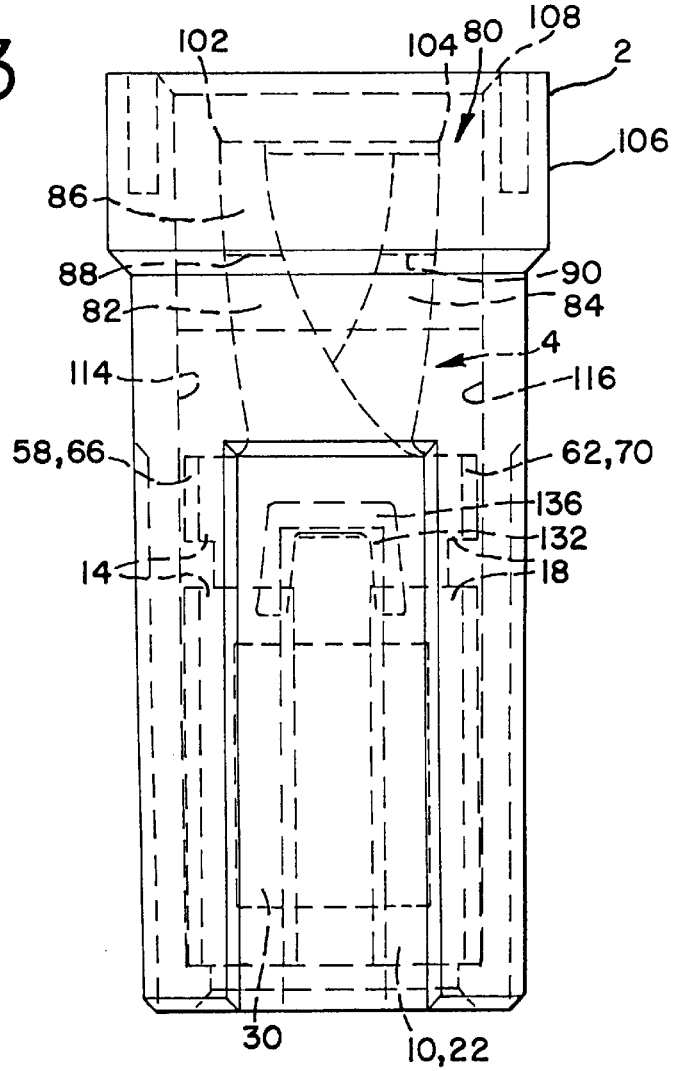
FIG. 3 is a left-side view of the embodiment from FIG. 1 of the present invention.
Figure 4:
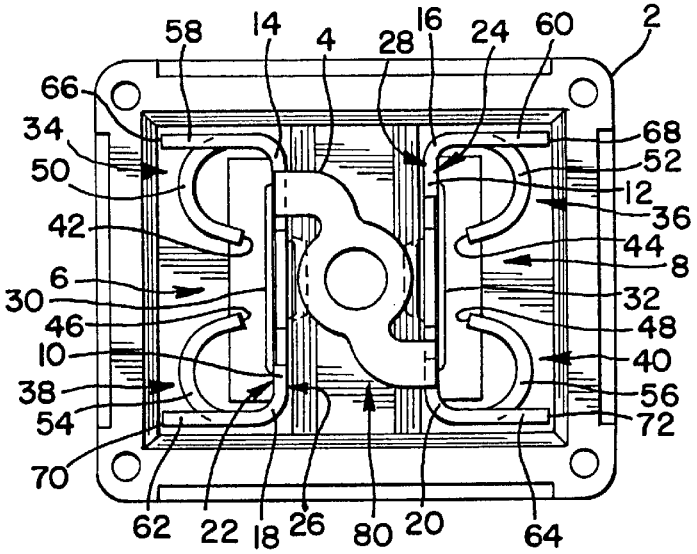
FIG. 4 is top view of the embodiment from FIG. 1 of the present invention.
Figure 5:
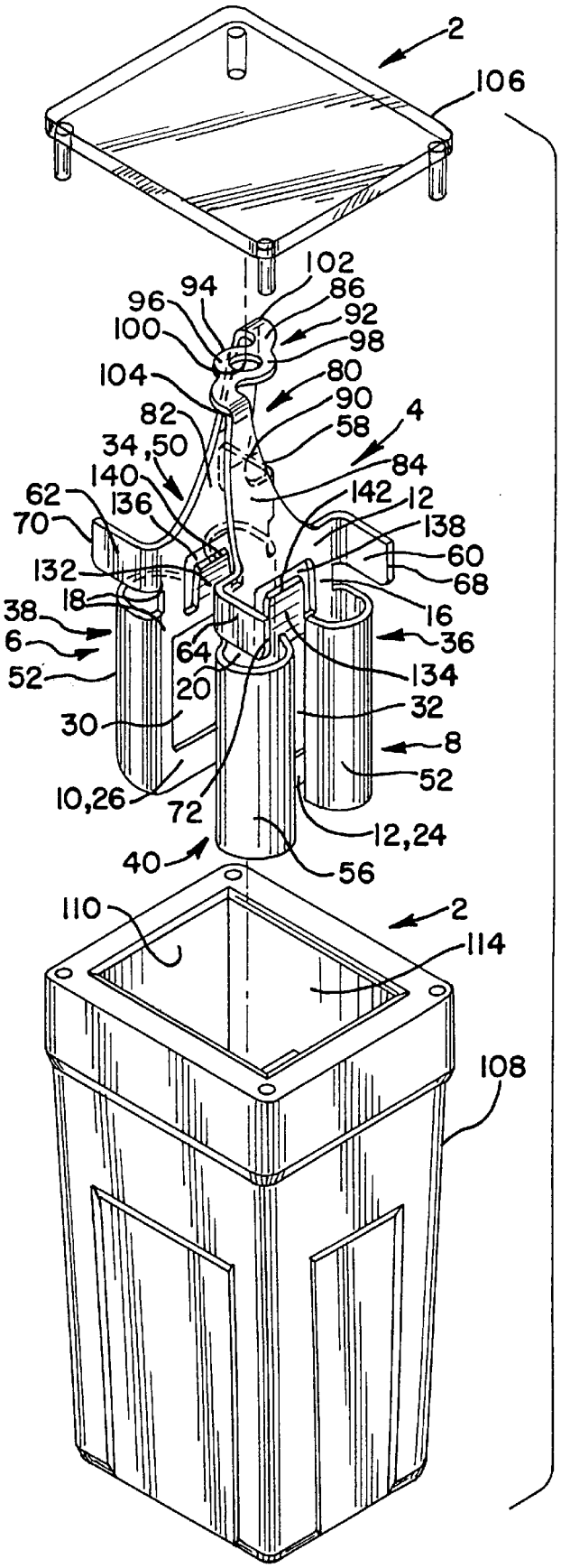
FIG. 5 is an exploded perspective view of the embodiment of FIG. 1 of the present invention.
Figure 6:
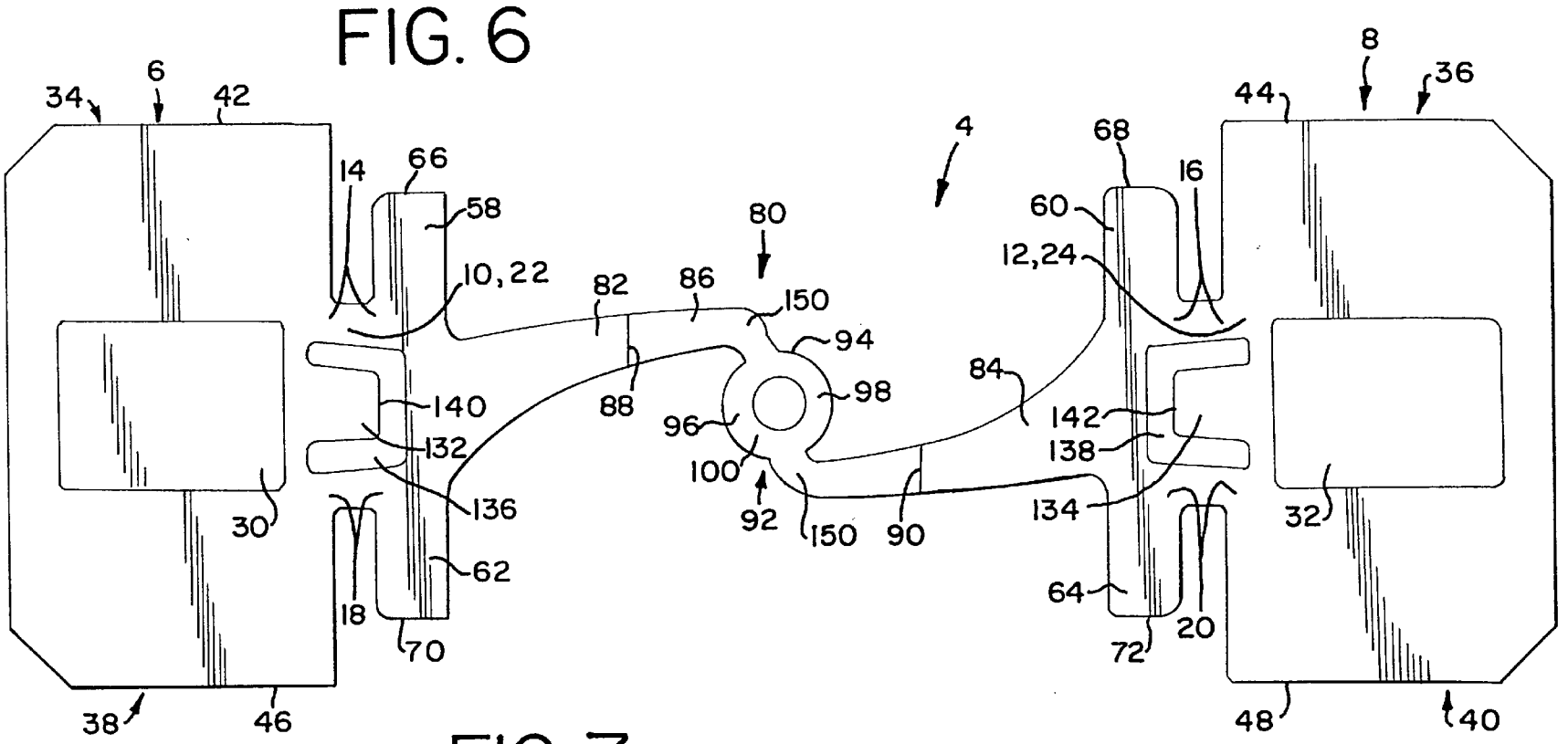
FIG. 6 is a top view of the female fuse embodiment of FIG. 1 of the present invention, in a preformed sheet configuration.
Figure 7:
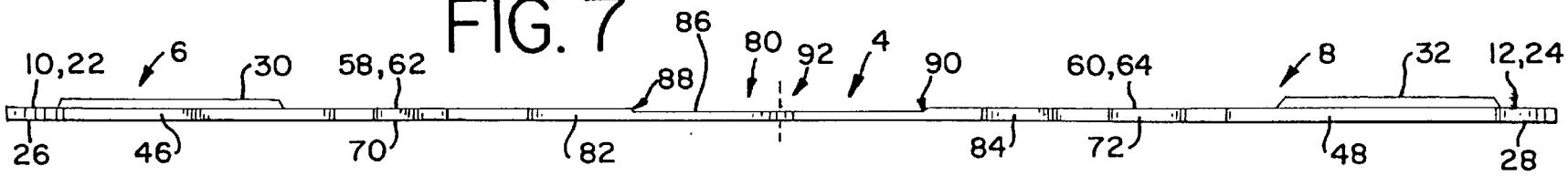
FIG. 7 is a front view of the preformed sheet configuration of the female fuse embodiment from FIG. 6 of the present invention.
Figure 10:
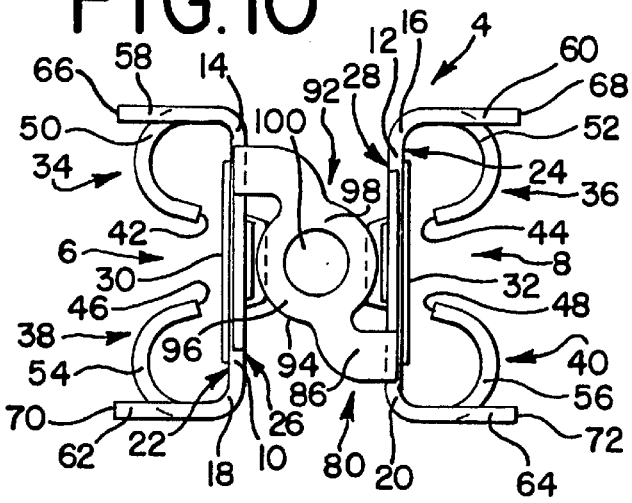
FIG. 10 is top view of the female fuse from FIG. 8 of the present invention.
Figure 8:
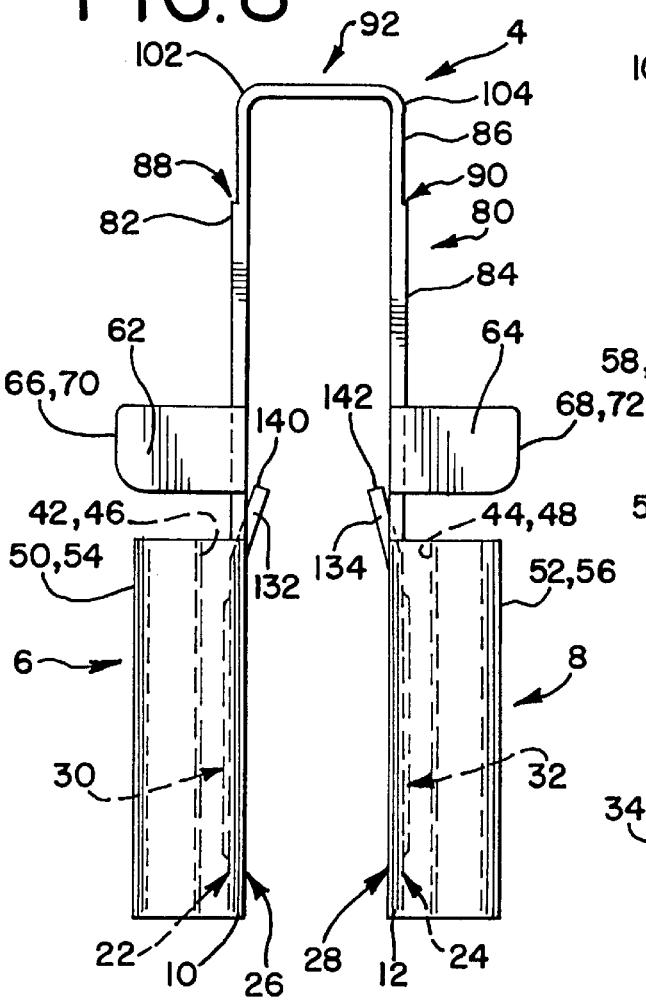
FIG. 8 is a front view of the female fuse from the female fuse assembly of FIG. 1 of the present invention.
Figure 9:
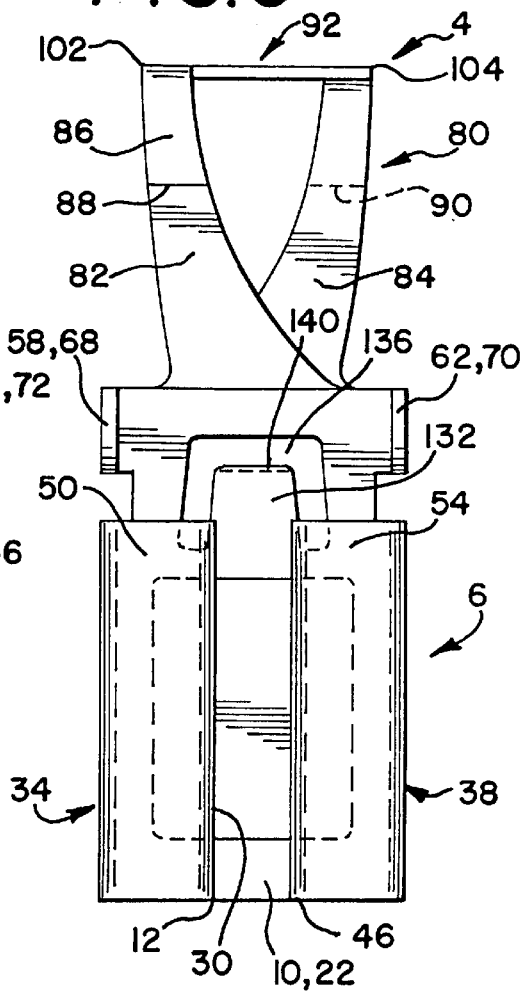
FIG. 9 is a left-side view of the female fuse from FIG. 8 of the present invention.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

FIGS. 1 through 5 show a female fuse assembly for interrupting current flowing through a circuit upon certain high current or over current conditions. Numerous occurrences can cause these types of conditions, as is well known in the art. The female fuse assembly is typically placed within a circuit to perform these functions. Specifically, the circuit includes male terminals (not shown) which typically are a part of a male terminal block or fuse block (not shown) for inserting the female fuse assembly onto the male terminal block. Each male terminal has opposed contact surfaces for conductively connecting the female fuse assembly to the rest of the circuit, as will be further described below.

The female fuse assembly of FIGS. 1 through 5 generally includes a fuse housing 2 and a female fuse 4. The female fuse 4, more clearly shown in FIGS. 6 through 10, is made from one continuous sheet of metal, preferably a copper alloy, and several manufacturing steps cuts out and otherwise forms the metal sheet into the embodiment in FIGS. 1 through 5 as will be described further below. The female fuse 4 includes a first female terminal portion 6 and a second female terminal portion 8. The first female terminal portion 6 includes a first face portion 10 and the second female terminal portion 8 includes a second face portion 12. The first and second face portions each include a first end 14, 16, a second end 18, 20, a first side 22, 24, and a second side 26, 28, respectively.

The first side 22 of the first face portion 10 of the first female terminal portion 6 includes a first raised portion 30. The first raised portion 30 is formed by pressing out a rectangular shape into the second side 26 of the first face portion 10. Likewise, the first side 24 of the second face portion 12 of the second female terminal portion 8 includes a second raised portion 32.

The second raised portion 32 is again formed by pressing out a rectangular shape into the second side 28 of the second face portion 12. The first and second raised portions 30, 32 are provided on the first and second face portions 10, 12, respectively, for creating a secure engagement with the male terminals. The raised portions are also provided for creating a large surface area of contact between the face portions 10, 12 and the male terminals, to reduce resistance between the female terminal portions 6, 8 and the male terminals.

The female fuse 4 further includes a first clamping arm 34 connected to the first end 14 of the first face portion 10, a first clamping arm 36 connected to the first end 16 of the second face portion 12, a second clamping arm 38 connected to the second end 18 of the first face portion 10, and a second clamping arm 40 connected to second end 20 of the second face portion 12, of the respective first and second female terminal portions 6, 8. The first clamping arm 34 of the first female terminal portion 6 includes a first contact edge 42, and the first clamping arm 36 of the second female terminal portion 8 includes a first contact edge 44. Likewise, the second clamping arm 38 of the first female terminal portion 6 includes a second contact edge 46, and the second clamping arm 40 of the second female terminal portion 8 includes a second contact edge 48. Each of these contact edges 42, 44, 46, 48 generally face and extend toward the respective first side 22, 24 each of the respective first and second female terminal portions 6, 8, after the female fuse 4 is formed during manufacture. These contact edges 42, 44, 46, 48 are provided to engage the male terminals when the male terminals are inserted into the female terminal portions 6, 8. When the male terminals are inserted, the contact edges 42, 44, 46, 48 press against one side of the male terminals, and force the male terminals into effective contact with the respective first and second raised portions 30, 32.

To achieve an effective contact between the male terminals and the respective raised portions 30, 32, each clamping arm includes a semicircular portion formed at a proper bend, and made of a sufficient resiliency. Specifically, the first clamping arm 34 of the first female terminal portion 6 includes a first resilient semicircular portion 50, and the first clamping arm 36 of the second female terminal portion 8 includes a first resilient semicircular portion 52. Likewise, the second clamping arm 38 of the first female terminal portion 6 includes a second resilient-semicircular portion 54, and the second clamping arm 40 of the second female terminal portion 8 includes a second resilient semicircular portion 56. FIGS. 6, 7, 11 and 12 do not show these semicircular portions 50, 52, 54, 56 as these portions are created by bending the respective clamping arms 34, 36, 38, 40 toward the first sides 22, 24 of the respective first and second faces 10, 12 of the first and second female terminal portions 6, 8.

The female fuse 4 further includes a first bracing arm 58 connected to the first end 14 of the first face portion 10 of first female terminal portion 6, and a first bracing arm 60 connected to the first end 16 of the second face portion 12 of second female terminal portion 8. Likewise, the female fuse 4 includes a second bracing arm 62 connected to the second end 18 of the first face portion 10 of first female terminal portion 6, and a second bracing arm 64 connected to the second end 20 of the second face portion 12 of second female terminal portion 8. The first bracing arm 58 of the first female terminal portion 6 includes a first bracing edge 66, and the first bracing arm 60 of the second female terminal portion 8 includes a first bracing edge 68. Likewise, the second bracing arm 62 of the first female terminal portion 6 includes a second bracing edge 70, and the second bracing arm 64 of the second female terminal portion 8 includes a second bracing edge 72. The first and second bracing arms, 58, 60, 62, 64 of the respective first and second female terminal portions 6, 8 are arranged substantially perpendicular to the respective first and second face portion 10, 12 of the first and second female terminal portions 6, 8. Thus, the first and second bracing edges 66, 68, 70, 72 extend away from, and perpendicular to, the respective first side 22, 24 of the first and second face portion 10, 12 of the respective first and second female terminal portions 6, 8. The bracing arms 58, 60, 62, 64 and bracing edges 66, 68, 70, 72 are provided for bracing and stabilizing the female fuse 4 within the housing 2, as will be described in greater detail below.

The female fuse 4 additionally includes a fuse link 80. The fuse link 80 includes a first terminal extension 82 and a second terminal extension 84. The first terminal extension 82 is connected to the first female terminal portion 6, and the second terminal extension 84 is connected to the second female terminal portion 8. The fuse link 80 further includes a skived region 86 connected between the first and second terminal extensions 82, 84 at a first transition point 88 and a second transition point 90. The skived region 86 is provided for controlling the resistance between the first and second female terminal portions, as the resistance will vary by changing the thickness of the fuse link 80. During manufacture, skiving takes place before the female fuse 4 is formed. Specifically, the thickness is reduced in a specified area along a full sheet of metal before the sheet of metal is cut or stamped into the female fuses. The reduction of thickness takes place through known reduction techniques, such that the reduced area, or skived regions has a substantially uniform thickness. Skiving creates a more uniform thickness, and thus, a more reliable opening time characteristic as well as other advantages, than does casting, stamping, coining, or other reduction technique.

The fuse link 80 also includes a fuse-blowing portion 92. The fuse-blowing portion 92 includes a ring 94 that has a first branch 96 and a second branch 98, which together form a pellet region 100. A pellet (not shown) can be placed within a pellet hole 100 or a pellet (not shown) can be placed on top of the pellet region 100, when no hole exists. The pellet region can be flat, or a divot can be created in the pellet region 100 to accept the pellet, without actually stamping a hole (pellet hole) within the pellet region. As described in U.S. Pat. No. 4,635,023 (Oh), entitled "Fuse Assembly Having a Non-Sagging Suspended Fuse Link," which is incorporated herein as a part of the present specification by reference, the fuse-blowing portion 92 of the fuse link 80 includes a hot spot portion or ring 94, and a fuse-blowing current-reducing material or pellet (not shown) placed within or joined with the pellet region 100. The material used to reduce the opening current within the pellet region 100 is preferably tin, while the overall female fuse 4 is preferably a copper alloy. In addition, the fuse link 80 configuration alleviates the need for any heat conduction member, and requires no additional structure for heat insulating the fuse link 80 or the female fuse 4.

The formed fuse link 80 further includes a first terminal bend 102 and a second terminal bend 104. In one embodiment, the first terminal bend 102 is positioned substantially toward the first end 14 of the first face portion 10 of the first female terminal portion 6, and the second terminal bend 104 is positioned substantially toward the second end 20 of the second face portion 12 of the second female terminal portion 8. In another embodiment of the present invention, the first terminal bend 102 is positioned substantially toward the second end 18 of the first face portion 10 of the first female terminal portion 6, and the second terminal bend 104 is positioned substantially toward the first end 16 of the second face portion 12 of the second female terminal portion 8. The placement of the bends 102, 104 within the female fuse 4 increases the length of the fuse link 80 without requiring the use of any additional volume of metal material to create the female fuse 4. Moreover, increasing the length of the fuse link 80 in this fashion, and in the embodiments described below, actually reduces the amount of material which is discarded during manufacture.

Other configurations for the connections between the female fuse terminals 6, 8 and the terminal extensions 82, 84, will achieve a lengthened fuse link 80 without increasing the volume of material used, as well. Specifically, another embodiment of the present invention includes that the connection between the first female terminal portion 6 and the first terminal extension 82 of the fuse link 80 is positioned substantially toward the first end 14 of the first face portion 10 of the first female terminal portion 6, and includes that the connection between the second female terminal portion 8 and the second terminal extension 84 of the fuse link 80 is positioned substantially toward the first end 16 of the second face portion 12 of the second female terminal portion 8. Another embodiment of the present invention includes that the connection between the first female terminal portion 6 and the first terminal extension 82 of the fuse link 80 is positioned substantially toward the first end 14 of the first face portion 22 of the first female terminal portion 6, and includes that the connection between the second female terminal portion 8 and the second terminal extension 84 of the fuse link 80 is positioned substantially toward the second end 20 of the second face portion 12 of the second female terminal portion 8. Another embodiment of the present invention includes that the connection between the first female terminal portion 6 and the first terminal extension 82 of the fuse link 80 is positioned substantially toward the second end 18 of the first face portion 10 of the first female terminal portion 6, and includes that the connection between the second female terminal portion 8 and the second terminal extension 84 of the fuse link 80 is positioned substantially toward the second end 20 of the second face portion 12 of the second female terminal portion 8. Another embodiment of the present invention includes that the connection between the first female terminal portion 6 and the first terminal extension 82 of the fuse link 80 is positioned substantially toward the second end 22 of the first face portion 10 of the first female terminal portion 6, and includes that the connection between the second female terminal portion 8 and the second terminal extension 84 of the fuse link 80 is positioned substantially toward the first end 16 of the second face portion 12 of the second female terminal portion 8.

One feature which most embodiments have in common is that the fuse link 80 is non-linear. Previous fuses used a fuse link which extended linearly from the first female terminal to the second female terminal when viewed from the side of the fuse (facing a face portion). No lateral curves or bends existed in these previous fuse links from a side view. The present fuse 4 has at least two lateral curved portions 150 which break the linearity of the fuse link 80, for increasing the length of the fuse link 80 without using any additional fuse material during manufacture.

After the female fuse 4 is formed, generally in the shape of the female fuse 4 from FIGS. 1 through 5, and 8 through 10, the female fuse is placed within the housing 2, as shown in FIGS. 1 through 5. The housing 2 includes a main portion 106 and a cap 108. The fuse housing 2 is made of electrically insulating material, such as a synthetic polymer or plastic. The main portion 106 includes a first interior wall 110, a second interior wall 112, a third interior wall 114, and a fourth interior wall 116, a divider 118 extended between the third and the fourth interior walls 114, 116, all defining a space therein. The divider is provided for partially dividing the space, and includes a first interior cutout portion 120 and a second interior cutout portion 122. The first interior cutout portion 120 includes and is defined by a first cutout side wall 124 and a first cutout upper wall 126. The second interior cutout portion 122 includes and is defined by a second cutout side wall 128 and a second cutout upper wall 130. At the top of the divider (central island) a flexible member (not shown) can be optionally provided for assisting in holding the female fuse in place when the clamping arms 34, 36, 38, 40 face inwardly, or when the female fuse terminals 300, 301 (embodiment described below) face inwardly. The female fuse terminals of the various embodiments would snap securely into place through the lances, and additionally through the flexible member (not shown) disposed on the divider (central island).

For the purpose of securing the female fuse within main portion 106 of the housing 2, the first female terminal portion 6 includes a first lance 132. The first lance is defined by a first lance cutout portion 136 on the first face portion 10 of the first female terminal portion 6, and is substantially centered between the first and second ends 14, 18 of the first face portion 10 of the first female terminal portion 6. The first lance 132 includes a first lance edge 140. Likewise, the second female terminal portion 8 further includes a second lance 134. The second lance 134 is defined by a second lance cutout portion 138 on the second face portion 12 of the second female terminal portion 8, and is substantially centered between the first and second ends 16, 20 of the second face portion 12 of the second female terminal portion 8. The second lance 134 also has a second lance edge 142. When the female fuse 4 is inserted into the main portion 108 of the housing 2, the first lance edge locks into the first interior cutout portion 120, and engages with the first cutout upper wall 126. Likewise, the second lance edge 142 locks into the second interior cutout portion 122, and engages with the second cutout upper wall 130. The cap 108 of the housing 2 is preferably transparent, and locks into the main portion 108 through well known techniques.

Figure 11:
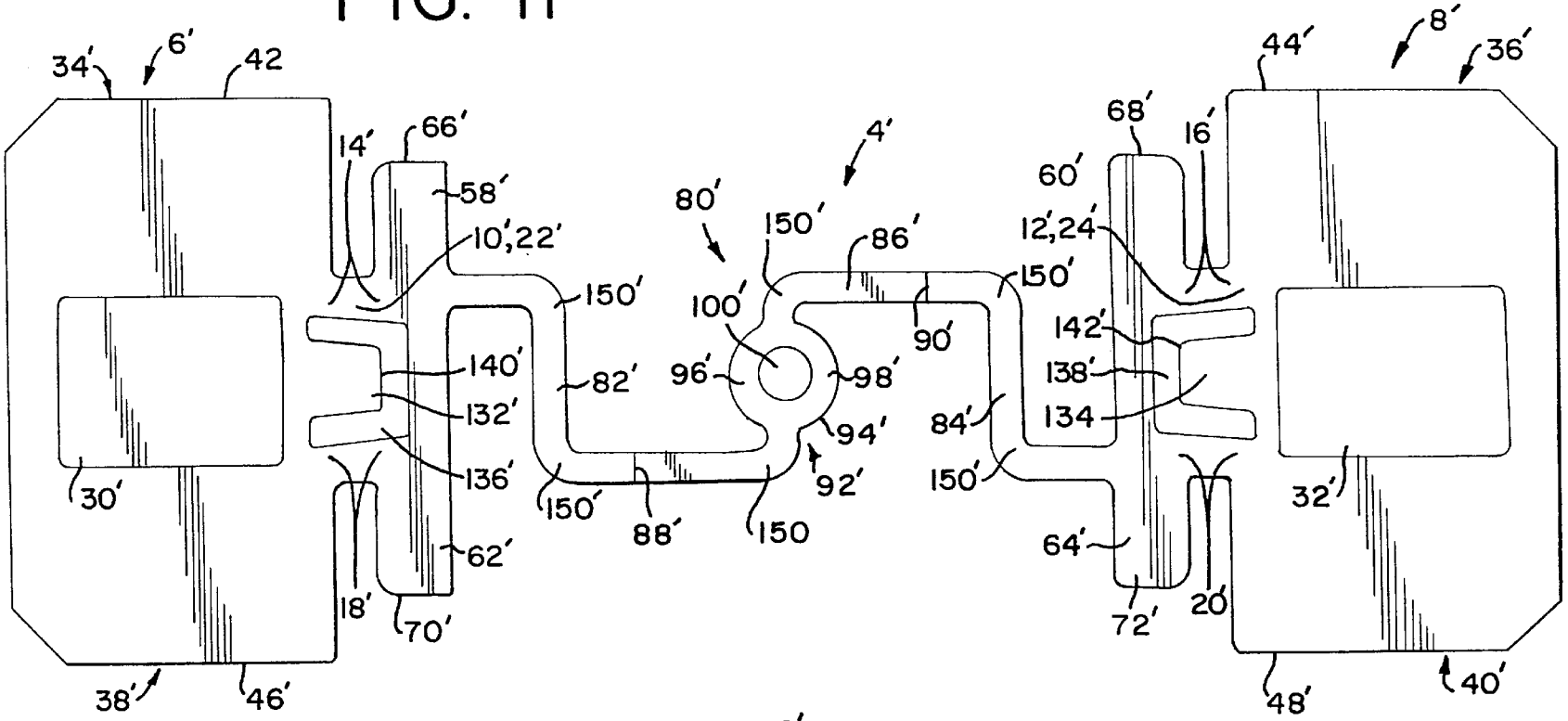
FIG. 11 is a top view of a separate female fuse embodiment of the present invention, in a preformed sheet configuration, similar to FIG. 6.
Figure 12:
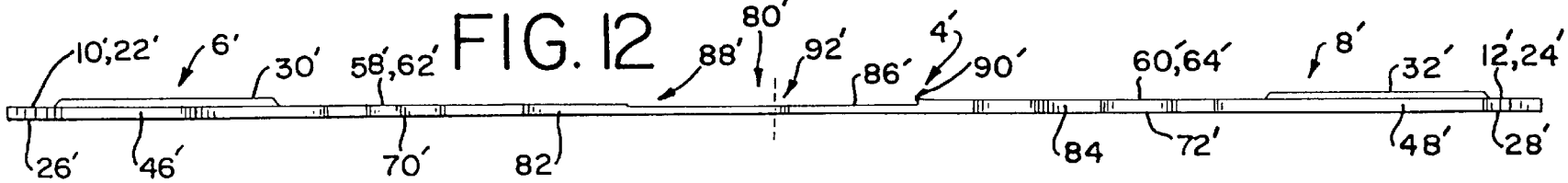
FIG. 12 is a front view of the preformed sheet configuration of the female fuse embodiment from FIG. 11 of the present invention.
Figure 13:
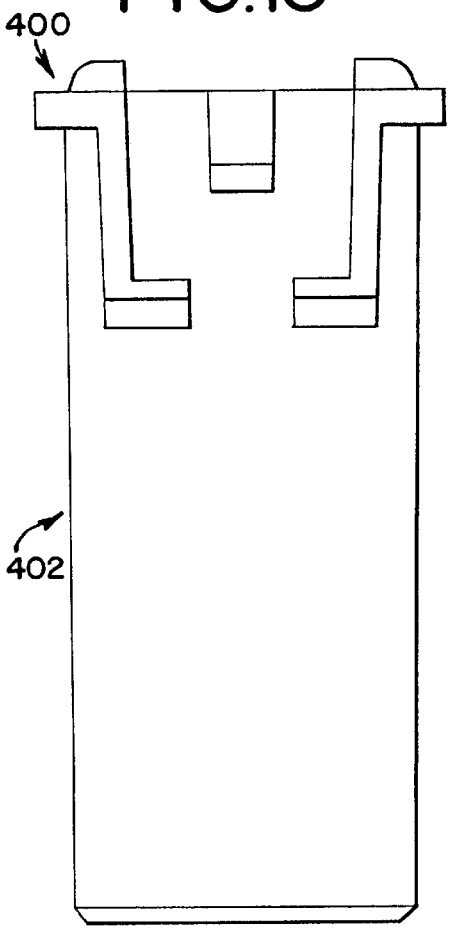
FIG. 13 is a left side view of a female fuse housing without a fuse lid.

An additional specific embodiment of the present invention is shown in FIGS. 11 and 12, and has generally already been described above. However, FIGS. 11 and 12 include reference to several common element numbers with a single prime designation instead.

A further additional embodiment of the present invention is shown is FIGS. 13 through 23. This additional representative embodiment is also stamped from single sheet of metal as can be understood by reference to FIGS. 17, 18, and 23.

Figure 18:
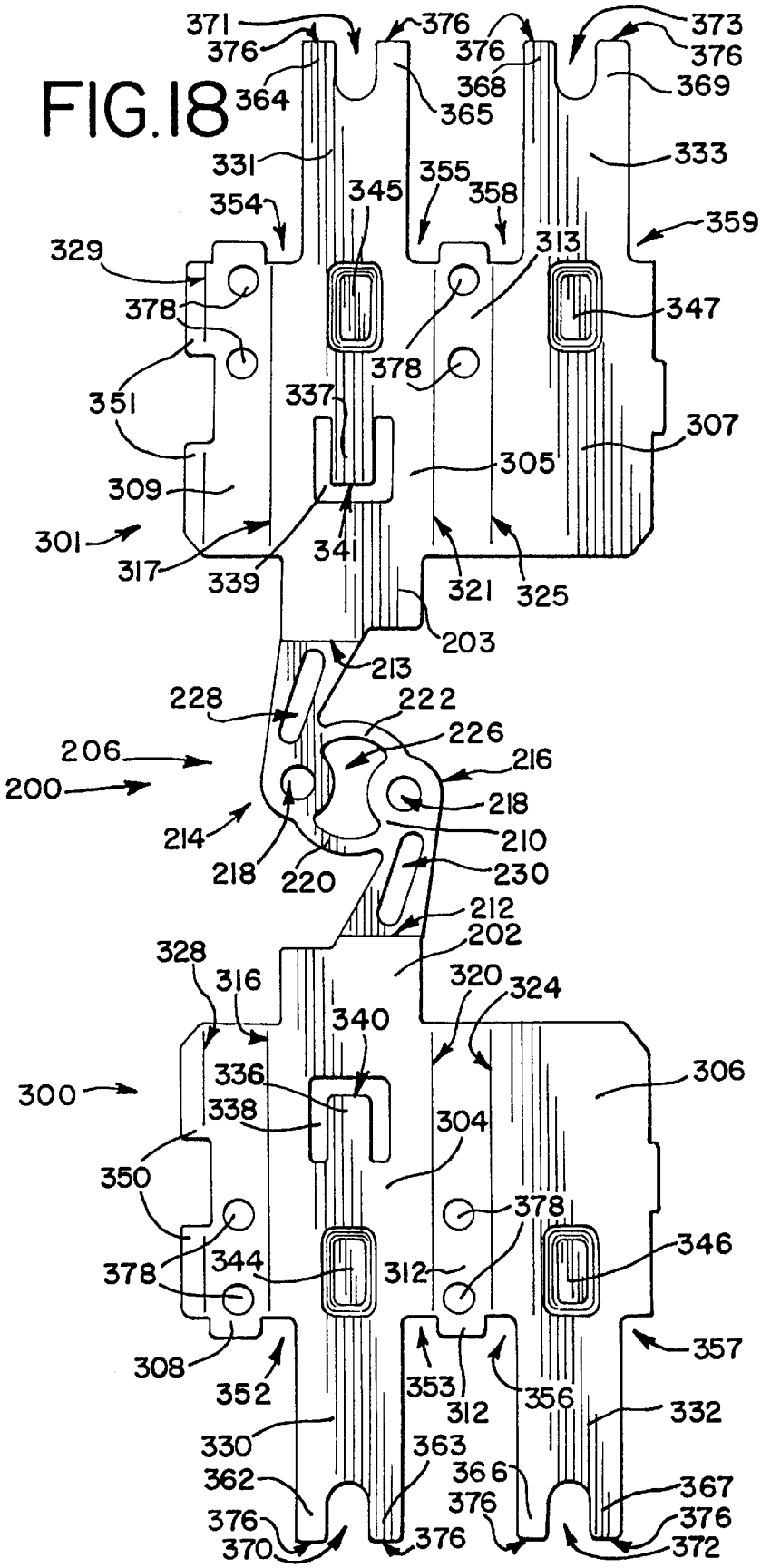
FIG. 18 is a top view of the female fuse embodiment of FIG. 16, in a preformed sheet configuration.
Figure 19:
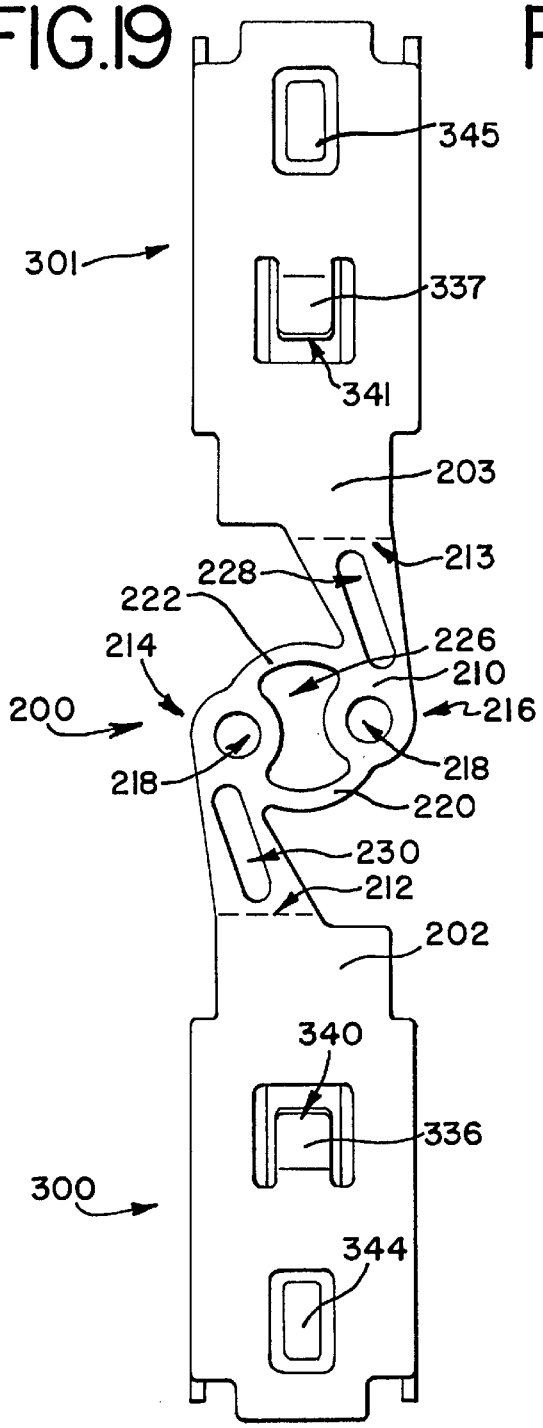
FIG. 19 is a bottom view of the female fuse from FIG. 18 with formed female fuse terminals.
Figure 20:
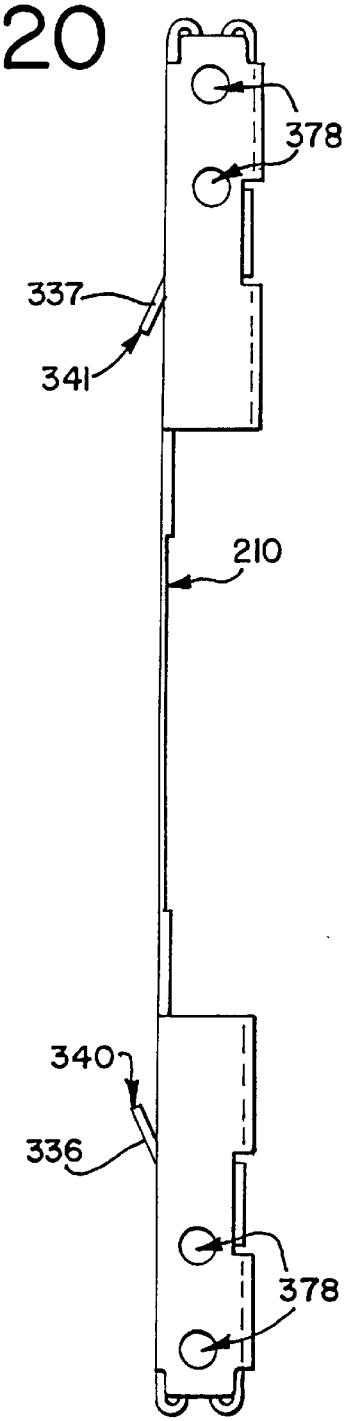
FIG. 20 is a side view of the female fuse in FIG. 19.
Figure 21:
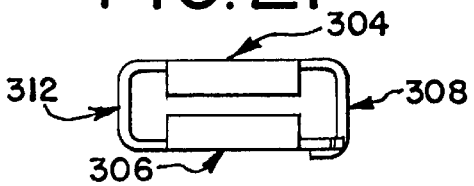
FIG. 21 is a partial front view of a female fuse terminal of the female fuse from FIG. 20.
Figure 22:
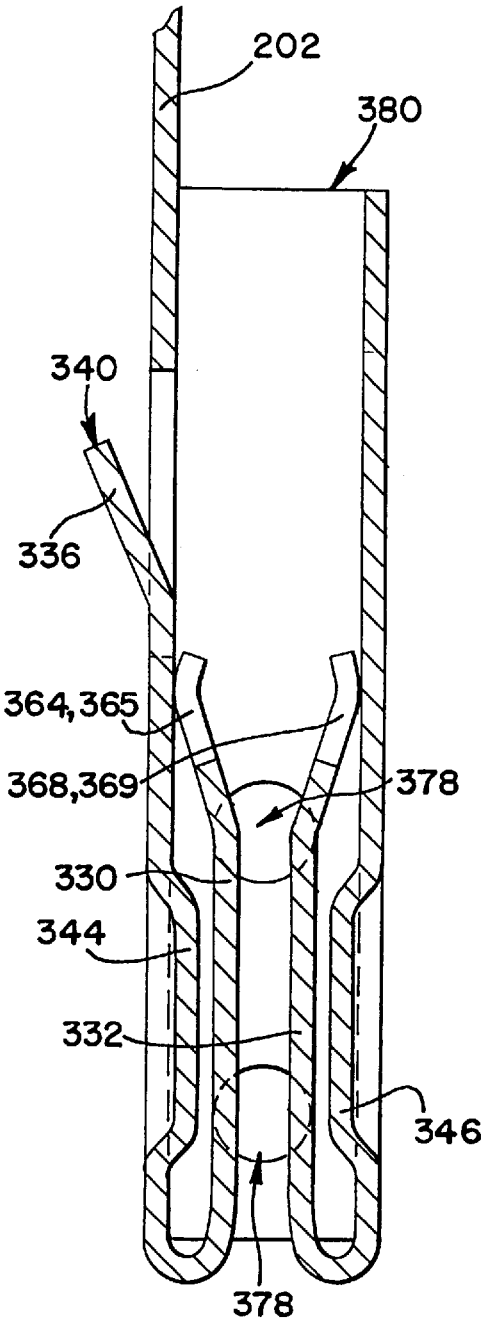
FIG. 22 is a enlarged cutaway side view of a single female fuse terminal of the female fuse in FIG. 16.

Referring to FIG. 18, a female fuse is shown for interrupting a current flowing through a circuit that includes the female fuse, upon certain high current conditions. The female fuse is configured to accept male terminals (not shown) which are typically mounted on a male terminal block (not shown) as described above. The male terminals are also a part of, and are connected to, the circuit.

The female fuse includes a fuse link 200 that has a first end 202 and a second end 203. The fuse link 200 includes a fuse-blowing portion between the first and second ends 202, 203 for interrupting the current flowing through the circuit. The female fuse also includes first and second female fuse terminals 300, 301 that are coupled to the respective first and second ends 202, 203 of the fuse link 200. The first and second female fuse terminals 300, 301 each includes first and second female-forming terminal plates 304, 305, 306, 307. Each female fuse terminal 300, 301 also includes first and second female-forming side plates 308, 309, 312, 313. The first and second female-forming side plates 308, 309, 312, 313 are each coupled to the first female-forming plates 304, 305 at substantially respective first and second boundaries 316, 317, 320, 321. The second female-forming terminal plates 306, 307 are each coupled to the respective second side plates 312, 313 at substantially third boundaries 324, 325, respectively. The first and the second female-forming terminal plates 304, 305, 306, 307 each include a spring portion 330, 331, 332, 333, respectively. The spring portions 330, 331, 332, 333 are formable into contacting springs (easily understood from FIG. 22) for directly contacting the male terminals (not shown) when the male terminals are inserted into the female fuse terminals 300, 301, once formed. The first and second female-forming side plates 308, 309, 312, 313 and the first and second female-forming terminal plates 304, 305, 306, 307 are formable to generally encompass the spring portions 330, 331, 332, 333 and the male terminals, when the male terminals are inserted into the formed female fuse terminals (easily understood from FIG. 16 and 17). The formed female terminals 300, 301 (FIG. 17) take on a box-like shape. The formation of the female fuse will be described in greater detail further below. However, the double spring configuration lowers the insertion force required to get the male terminals into the female fuse, centers the male terminals within each female terminal 300, 301.

The female fuse shown in FIGS. 13 through 23 is formed from one continuous sheet of metal. The sheet is made from a copper alloy. Preferably, the sheet is made from C-151, C-194, or 425. The first and second female fuse terminals 300, 301 also each includes first and second lances 336, 337, respectively. The lances 336, 337 are defined by first and second lance cutout portions 338, 339, respectively. The lances 336, 337 and respective cutout portions 338, 339 are substantially centered between the first and second boundaries 316, 317, 320, 321, and the first and second lances 336, 337 each have a respective lance edge 340, 341.

The first and second female-forming plates 304, 305, 306, 307 each include respective first and second raised portions 344, 345, 346, 347. These raised portions 344, 345, 346, 347 serve as overstress protection (OSP) for the spring portions 330, 331, 332, 333 when a male terminal is inserted into the female fuse terminals 300, 301. Specifically, if a male terminal is inserted into a formed female fuse terminal 300 or 301 at an angle that is not parallel or in-line with the spring portions 330, 331, 332, 333, the male terminal will contact and depress the spring portion 330, 331, 332, or 333. If no raised portion 344, 345, 346, or 347 existed, the spring portion 330, 331, 332, 333 may overstress and permanently bend out of shape. However, with the existence of the raised portion 344, 345, 346, 347, the spring portion 330, 331, 332, 333 can only depress until the spring portion 330, 331, 332, 333 contacts the raised portion 344, 345, 346, 347, thereby providing overstress protection. This type of OSP is significant since the protection (raised portions) extends over almost the full length of the spring portions 330, 331, 332, 333. The raised portions 344, 345, 346, 347 can be created through the use of a die section puncher or embosser.

The first and second boundaries 316, 317, 320, 321 are scored. In addition, the third and fourth boundaries 324, 325, 328, 329 are scored. These scoring lines shown in FIG. 18 allow for ease of bending and formation of the female fuse terminals 300, 301. For the purpose of this detailed description,.the scoring lines provide an imaginary separation (boundaries) between the several plates described above. Thus, use of the term boundary herein does not include scoring (only an imaginary line(s)), while use of the term scoring denotes actual scoring. Scoring lowers the stress on the materials during formation.

The first and second female fuse terminals 300, 301 also each include a first and second lip 350, 351, coupled to the first female-forming side plates 308, 309, respectively, substantially at the fourth boundaries 328, 329.

The first and second female-forming terminal plates 304, 305, 306, 307 each includes first and second notches 352, 353, 354, 355, 356, 357, 358, 359, respectively, substantially positioned on either side the respective spring portions 330, 331, 332, 333 therein. These notches 352, 353, 354, 355, 356, 357, 358, 359 provide additional spring-action to the respective spring portions 330, 331, 332, 333 associated therewith. The notches 352, 353, 354, 355, 356, 357, 358, 359 create the additional spring action in the spring portions 330, 331, 332, 333 by providing flexibility in the metal between the spring portions 330, 331, 332, 333 and the main body of the female forming terminal plates 304, 305, 306, 307. The spring action is more even with the use of the notches 352, 353, 354, 355, 356, 357, 358, 359. The notches 352, 353, 354, 355, 356, 357, 358, 359 also provides for ease of formation of the spring portions 330, 331, 332, 333 into the final position, as long as the notches 352, 353, 354, 355, 356, 357, 358, 359 are created before the spring portions 330, 331, 332, 333 are formed into the box-like female terminal configurations (final position). The notches 352, 353, 354, 355, 356, 357, 358, 359 also have a long term effect of preventing the spring portions 330, 331, 332, 333 from relaxing (bending out of shape) or prematurely breaking off (failing).

Figure 16:
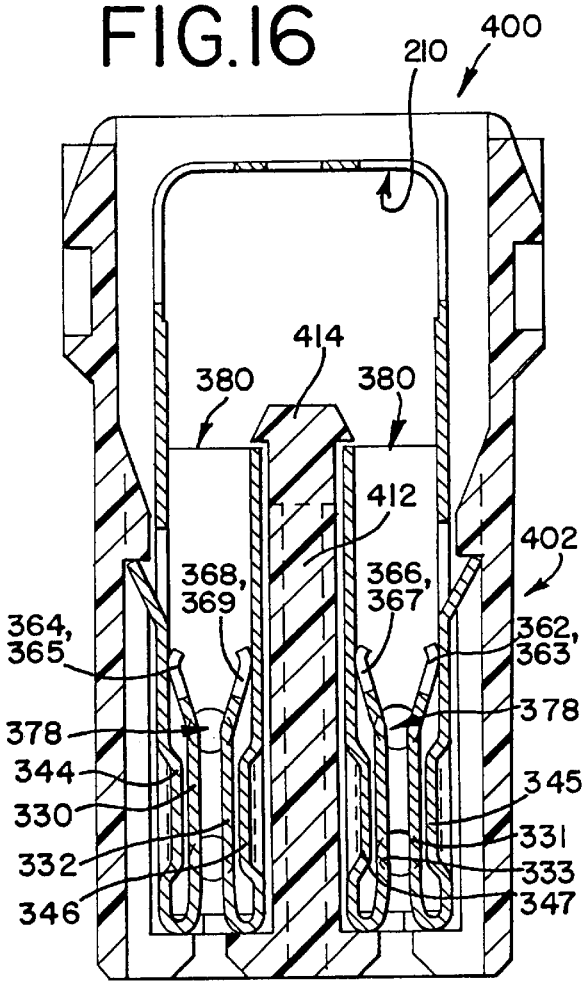
FIG. 16 is a cutaway front view of the female fuse housing from FIG. 13 with a further embodiment of a female fuse inserted therein, the cut away location being shown in FIG. 14.
Figure 14:
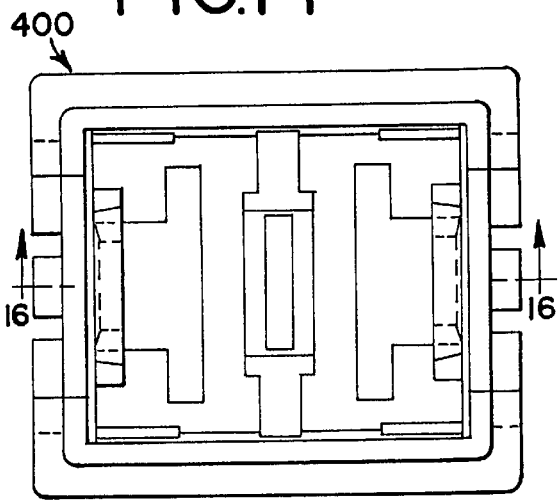
FIG. 14 is a top view of the female fuse housing from FIG. 13.
Figure 15:
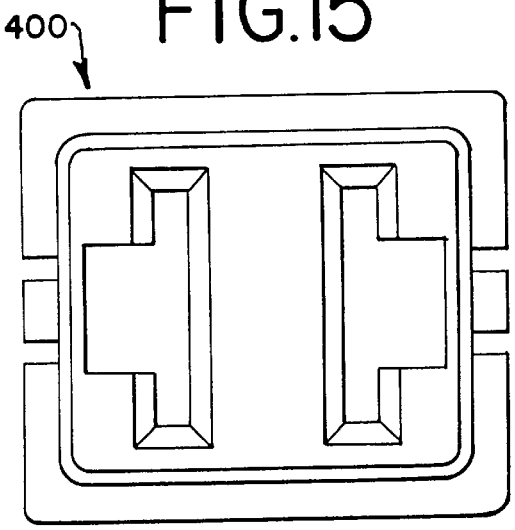
FIG. 15 is a bottom view of the female fuse housing of FIG. 13 without the female fuse being inserted therein.
Figure 17:
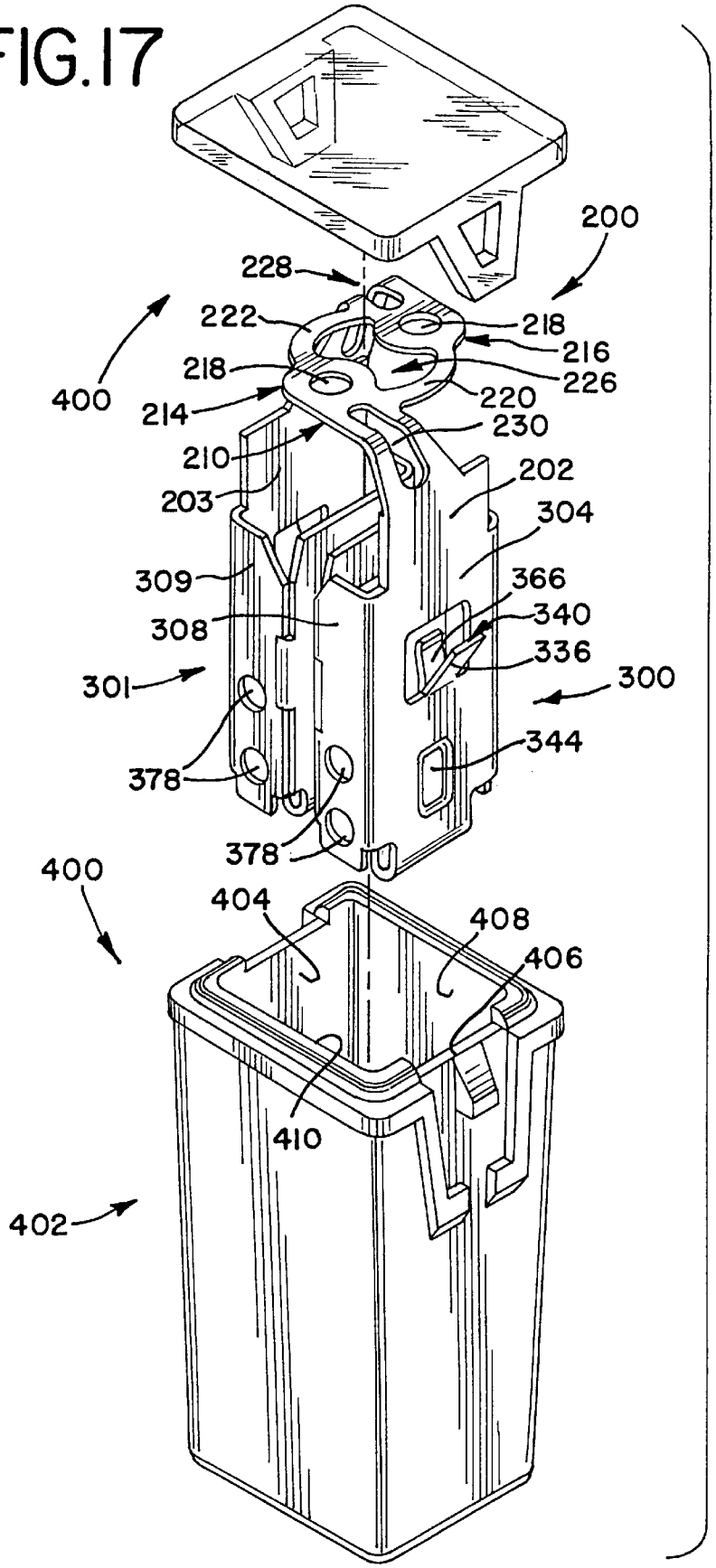
FIG. 17 is an exploded view of the embodiment of the female fuse of FIG. 16 with the female fuse housing exploded therewith.

The spring portions 330, 331, 332, 333 each include respective first and second spring legs 362, 363, 364, 365, 366, 367, 368, 369 formed on either side of a respective spring-leg forming notch 370, 371, 372, 373. Referring, in particular, to FIG. 16, the spring portions 330, 331, 332, 333 are bent to overlap a portion (overlap region) of the female-forming terminal plates 304, 305, 306, 307. The overlap region includes, at least, the raised portions 344, 345, 346, 347 thereunder. The first and second spring legs 362, 363, 364, 365, 366, 367, 368, 369 of the respective spring portions 330, 331, 332, 333 each include a termination edge 376 that is bent away from the overlapped portion of the female-forming terminal plates 304, 305, 306, 307.

Once the spring portions 330, 331, 332, 333 and associated elements are stamped and formed into the female fuse terminals 300, 301, the spring portions and associated elements need to be inspected. The female-forming side plates 308, 309, 312, 313, therefore, include viewing holes 378 for viewing into the interior of the box-like female fuse terminals 300, 301. A more thorough inspection, such as checking gap sizes, can then be performed on the spring portions 330, 331, 332, 333 and associated elements.

The fuse link of the female fuse embodiment in FIGS. 13 through 23 also includes a skived region 210 between first and second transition portions 212, 213. As described in detail above, the skived region 210 creates a substantially uniform thickness for the fuse link 200 between the first and second transition portions 212, 213. The uniform thickness enhances the performance of the fuse. The skiving thickness range is preferably 0.005–0.011 inches thick.

The fuse link 200 further includes first and second pellet regions 214, 216 (shown as circles in the Figures). A pellet hole 218 can exist in each pellet region 214, 216, and tin pellets can be placed into the holes 218. However, holes 218 are not necessary in one form of the present invention, as divots (not shown) or just a flat surface can be used to support tin pellets. In a preferred form of the present invention, each pellet region 214, 216 will include a pellet hole 218, and both pellet holes 218 will be filled with pellets (tin). This form of the invention provides a relatively large mass on either side of where the fuse is intended to blow. It is preferable for the fuse to blow between the pellet regions because it allows a person to see that the fuse has blown through the transparent fuse housing cover. However, several alternative forms exist. For example, one pellet region 214 could have a pellet hole 218 and pellet therein, with the opposing pellet region 216 having no pellet hole or pellet therein (solid pellet region 216). In this form, it would not matter which pellet region 214, 216 the pellet hole 218 or pellet was on. However, only using a single pellet and pellet hole 218 in this example would require adjustments in the other slots.

In the embodiment in FIG. 18, the first and second pellet regions 214, 216 are symmetrically spaced on opposing sides of a central axis that extends substantially through center of both the first female-forming terminal plates 304, 305. The fuse link 200 also includes first and second arc-forming strips 220, 222 that are substantially symmetrically connect the first and second pellet regions 214, 216 to one another. The arc shape of the these strips increase the length of the fuse link 200 without the use of any additional material during manufacture. Increasing the arc will, accordingly, increase the length of the fuse length for improved rating performance.

The pellet regions 214, 216 and arc-forming strips 220, 222 each have an interior portion that form a bow-tie cut out portion 226. The bow-tie cutout portion 226 is formed from a bow-tie die section (not shown) existing within the single die that is used to create the overall fuse. The die includes a plurality of die sections or stamping sections which are independent of other die sections (stamping sections) within the single overall die. The bow-tie (slot) die section, within the overall die, is separate and distinct from the die section (stamping section) that formes the exterior shape of the female fuse. Thus, the bow-tie stamping section can be changed out within the overall die during manufacture to change to a different sized bow-tie stamp section in order to change the rating of the fuses being manufactured, without changing the stamping section (die section) used to form the exterior shape of the female fuse, as shown in FIG. 18.

The cross-sectional area of the arc-forming strips 220, 222 is partially determined by the skiving, partially determined by the die section foe the exterior shape of the female fuse, and partially determined by the bow-tie die section. Controlling this cross-sectional area will control the rating in the female fuse. Controlling the sizing of the other slots will also control the rating in the female fuse. Thus, there are numerous ways to fine tune the rating of the female fuse.

The fuse link 200 further includes first and second end slots 228, 230 substantially positioned in the respective first and second ends 202, 203. The end slots 228, 230 assist in controlling the rating of the fuse by providing a heat sinks on either side of the pellet regions 214, 216. Similar to the bow-tie die sections an end-slot die section (not shown) is used to create the end slots 228, 230. As such, the end-slot die section can be changed within the overall die (not shown) during manufacture, to change to a different sized end-slot die section in order to change the rating of the fuses being manufactured, without changing overall die or the die section used to form the exterior shape of the female fuse, as shown in FIG. 18. Providing the end slots 228, 230 and controlling the size of end slots 228, 230 assists in controlling the voltage drop across the fuse link 200, while increasing the time delay for the fuse to blow. These heat sinks act to pull heat away from the center of the fuse link 200 in order to increase the time delay. These end slots 228, 230 creating heat sinks further assist in making sure that the female fuse will blow on or between the pellet regions 214, 216. This configuration also provides for fast short circuit protection. Thus, the cross-sectional area of the arc-forming strips 220, 222 can be reduced while at the same time maintaining the same or better circuit protection features. One of these features includes keeping the time delay between approximately 200% and 300% of the rating current (characteristic power). Hence, this surge withstanding phase is provided while at the same time providing good short circuit protection.

For the purpose of this specification, the end slots 228, 230, the pellet holes 218 (when present), and the bow-tie cut out portion 226 (or other shape) are sometimes referred to collectively as slots. These size of these slots are changed to change the rating of the female fuse. Higher rated female fuses have smaller slots, and lower rated female fuses have larger slots. Separating the die sections with this type of female fuse arrangement for the fuse link 200 provides for a more simple process because only one perimeter female fuse stamp size (for one of the die sections) is needed to create all of the various ratings for the female fuses. Only the slot stamp sizes are changed to change the rating of the female fuse. This allows for a quicker changeover time during manufacture from one rated female fuse to another rated female fuse because the slot die section(s) is the only die section(s) that needs to be changed (different slots can come from different die sections). This, in turn, provides for lower labor and tooling costs.

However, when referred to as slots, the meaning of the term is not intended to take on any particular shape. Thus, the fuse link 200 of the present invention can also be described as including a plurality of slots creating a fuse-blowing portion 206. In a preferred form, the slots are substantially symmetrically positioned between the first and second ends 202, 203. The slots are substantially formed from one or more die sections that are independent of the die section which formes the exterior shape of the female fuse, as is described in greater detail above.

Figure 23:
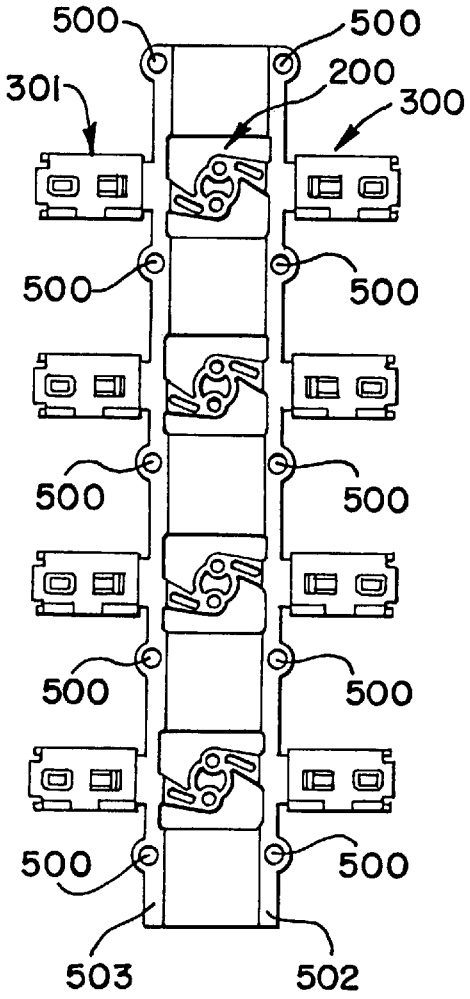
FIG. 23 is a top view of a plurality of female fuses shown during one step of the manufacturing process.

Referring to FIGS. 18 and 23, the method of manufacturing a plurality of the female fuses begins with a single continuous sheet of metal. The sheet is skived before any further steps are performed, although skiving does not have to be performed first. Guide bores 500 are used to guide the sheet through a main die (not shown) during the process of manufacture. The various elements of the female fuse are then stamped, punched, cut out or otherwise formed from different die sections located within the main die. Within this process, first and second guide strips 502, 503 are stamped from the sheet of metal. The strips 502, 503 are aligned traversely from or generally perpendicular to the central axis along the length of the female fuse described above. As an integral part of the present invention, the strips 502, 503 are located interior from the outermost portions of the female fuse terminals 300, 301. The outermost portion of the female fuse terminals coincide with the termination edge 376 of the spring portions 330, 331, 332, 333. In the embodiment shown in FIG. 23, the strips are aligned substantially between the ends 202, 203 of the fuse-link 200 and the female fuse terminals 300, 301.

In an even further set of embodiments of the present invention, the fuse-links 80, 80', and 200 can be interchanged to create a variety of female fuse arrangements with the various female fuse terminal arrangements.

Referring to FIGS. 13 through 17, a housing 400 is provided for the female fuse, that is similar to the housing in FIGS. 1 through 5. The housing 400 includes a main portion 402 that includes a first interior wall 404, a second interior wall 406, a third interior wall 408, and a fourth interior wall 410. A divider 412 extends between the third 408 and the fourth 410 interior walls, and defines a space therein for receiving the female fuse. The divider 412 partially divides the space, and the divider 412 has an overhanging semiresilient member 414 for engaging the upper interior edges 380 of the female fuse terminals 300, 301.

Furthermore, it will be understood that the invention may be embodied in other specific forms without departing from the spirit or central characteristics thereof, including, but not limited to, the orientations of the invention elements herein to achieve the above identified and other advantages. The present examples and embodiments, therefore, are to be considered in all respects as illustrative and not restrictive, and the invention is not to be limited to the details given herein.

What is claimed is:

1. A female fuse for interrupting a current flowing through a circuit including the female fuse upon certain high current conditions, and for accepting male terminals connected to the circuit, the female fuse comprising:

a fuse link having a first end and a second end, the fuse link including a fuse-blowing portion between the first and second ends for interrupting the current flowing through the circuit; and, first and second female fuse terminals coupled to the respective first and second ends of the fuse link, the first and second female fuse terminals each having first and second female-forming terminal plates and first and second female-forming side plates, the first and second female-forming side plates each being coupled to the first female-forming terminal plates at substantially respective first and second boundaries, the second female-forming terminal plates each being coupled to the respective second side plates at substantially third boundaries, respectively, the first and the second female-forming terminal plates each having a spring portion, the spring portions being formable into a first contacting spring and into a second contacting spring for contacting the male terminals when the male terminals are inserted into the female fuse terminals and to maintain contact between the male terminal and the first and second contacting springs over a substantial length of the first and second contacting springs to position the male terminal within the female fuse terminal, once formed, the first and second female-forming side plates and the first and second female-forming terminal plates being formable to generally encompass the spring portions and the male terminals when the male terminals are inserted into the formed female fuse terminals.

2. The female fuse of claim 1 wherein the female fuse is formed from one continuous sheet of metal.

3. The female fuse of claim 1 wherein the first and second female fuse terminals each further includes a first and a second lance, respectively, defined by respective first and second lance cutout portions, substantially centered between the first and second boundaries, the first and the second lances each having a respective lance edge.

4. The female fuse of claim 1 wherein the first and second female-forming plates each includes respective first and second raised portions.

5. The female fuse of claim 1 wherein the first and second boundaries are scored.

6. The female fuse of claim 1 wherein the first and second female fuse terminals each include a fourth boundary, and a first and a second lip, the fourth boundary located between the first and the second female-forming side plates and the lips, respectively.

7. The female fuse of claim 6 wherein the third and fourth boundaries are scored.

8. The female fuse of claim 1 wherein the first female-forming terminal plate of each female fuse terminal includes first and second notches substantially positioned on either side of the respective spring portion therein.

9. The female fuse of claim 1 wherein the second female-forming terminal plate of each female fuse terminal includes first and second notches substantially positioned on either side the respective spring portion therein.

10. The female fuse of claim 1 wherein the each spring portion includes first and second spring legs formed on either side of a spring-leg forming notch therein.

11. The female fuse of claim 1 wherein the spring portions are bent to overlap a portion of the female-forming terminal plates, and wherein the first and second spring legs each include a termination edge that is bent away from the overlapped portion of the female-forming terminal plates.

12. The female fuse of claim 1 wherein the first female-forming side plate includes a viewing hole.

13. The female fuse of claim 1 wherein the fuse link includes a skived region between first and second transition portions, the skived region creating a substantially uniform thickness for the fuse link between the first and second transition portions.

14. The female fuse of claim 1 wherein the fuse link includes first and a second pellet regions, the first and second pellet regions being symmetrically spaced on opposing sides of a central axis of the female fuse.

15. The female fuse of claim 1 wherein the fuse link includes first and second pellet regions at least one of the first and second pellet regions having a pellet joined thereto.

16. The female fuse of claim 1 wherein the fuse link includes first and second pellet regions, and first and second arc-forming strips substantially symmetrically connecting the first and second pellet regions to one another.

17. The female fuse of claim 1 wherein the female fuse is stamped from a single sheet of metal, and wherein the fuse link includes a plurality of slots creating a fuse-blowing portion, the slots being positioned between the first and second ends.

18. The female fuse of claim 17 further comprising first and second pellet regions between the first and second ends, the first and second pellet regions being substantially symmetrically spaced on opposing sides of a central axis of the female fuse, the fuse link further including first and second arc-forming strips connecting the first and second pellet regions to one another, an interior portion of the pellet regions and an interior portion of the arc-forming strips forming one of the slots.

19. The female fuse of claim 18 wherein at least one pellet region includes a pellet hole as one of the slots.

20. The female fuse of claim 17 wherein the slots include first and second end slots substantially positioned between the respective first and second ends for assisting in controlling the rating of the fuse.

* * * * *

UNITED STATES PATENT AND TRADEMARK OFFICE

CERTIFICATE OF CORRECTION

PATENT NO. : 5,929,740
DATED : July 27, 1999
INVENTOR(S) : Seibang Oh, et al.

It is certified that error appears in the above-identified patent and that said Letters Patent is hereby corrected as shown below:

Column 2,
Line 35, delete "waisted" and insert therefor -- wasted --

Column 10,
Line 46, delete "." after the word description and replace with ",".

Column 12,
Line 20, delete "Formes" and insert therefor -- Forms --
Line 29, delete "Foe" and insert therefor -- For --

Column 13,
Line 23, delete "Formes" and insert therefor -- Forms --

Signed and Sealed this

Twenty-fourth Day of July, 2001

*Attest:*

Nicholas P. Godici

*Attesting Officer*

NICHOLAS P. GODICI
*Acting Director of the United States Patent and Trademark Office*